US011905074B2

(12) United States Patent
Haon et al.

(10) Patent No.: US 11,905,074 B2
(45) Date of Patent: Feb. 20, 2024

(54) PACKAGING WITH TAMPER-EVIDENT SEAL

(71) Applicant: ROQUETTE FRERES, Lestrem (FR)

(72) Inventors: Bruno Haon, La Couture (FR); Gauthier Lemaire, Fournes en Weppes (FR); Jerome Mugnier, L'Abergement de Cuisery (FR); Stephane Navoret, Saint Claude (FR)

(73) Assignee: Roquette Freres, Lestrem (FR)

( * ) Notice: Subject to any disclaimer, the term of this patent is extended or adjusted under 35 U.S.C. 154(b) by 278 days.

(21) Appl. No.: 17/291,831

(22) PCT Filed: Oct. 10, 2019

(86) PCT No.: PCT/FR2019/052407
§ 371 (c)(1),
(2) Date: May 6, 2021

(87) PCT Pub. No.: WO2020/094932
PCT Pub. Date: May 14, 2020

(65) Prior Publication Data

US 2021/0387775 A1 Dec. 16, 2021

(30) Foreign Application Priority Data

Nov. 6, 2018 (FR) ..... 18 60201
Mar. 21, 2019 (FR) ..... 19 02919

(51) Int. Cl.
*B65D 43/02* (2006.01)
*B65D 21/02* (2006.01)

(52) U.S. Cl.
CPC ..... *B65D 43/0256* (2013.01); *B65D 21/0219* (2013.01); *B65D 2401/35* (2020.05);
(Continued)

(58) Field of Classification Search
CPC ..... B65D 2543/00685; B65D 2543/00101; B65D 21/0219; B65D 2401/25; B65D 43/0256
See application file for complete search history.

(56) References Cited

U.S. PATENT DOCUMENTS 4,718,571 A 1/1988 Bordner
5,425,467 A 6/1995 Feer et al.
(Continued)

FOREIGN PATENT DOCUMENTS

DE 20012643 U1 1/2001
EP 0110859 A1 6/1984
(Continued)

OTHER PUBLICATIONS

The English translation of the Chinese Office Action, dated Jun. 28, 2022, in the related Chinese Patent Application No. 201980075866.X.
(Continued)

*Primary Examiner* — Jeffrey R Allen

(57) ABSTRACT

A packaging comprising, a container made of plastic and comprising lateral walls, an upper opening and a bottom and, on the other hand, a lid that is made of plastic, is detachable and is configured to cover the upper opening of the container, and in which the container is provided at its upper opening with a first engagement portion bearing an outwardly directed ridge running around the periphery, said lid being provided on its peripheral part with a second engagement portion that extends folded downward and provided with an inwardly directed ridge which is able to latch underneath the outwardly directed ridge of the container, and in which the second engagement portion of the lid has a skirt with a skirt section that can be folded back and
(Continued)

that bears a lug which is able to latch onto a second outwardly directed ridge of the container.

19 Claims, 10 Drawing Sheets

(52) U.S. Cl.
CPC ..... *B65D 2543/00027* (2013.01); *B65D 2543/00101* (2013.01); *B65D 2543/00296* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/00796* (2013.01); *B65D 2543/00842* (2013.01)

(56) References Cited

U.S. PATENT DOCUMENTS

| | | | | |
|---|---|---|---|---|
| 5,730,309 | A | 3/1998 | Jiradejnunt et al. | |
| 6,793,096 | B1 | 9/2004 | Seok | |
| 2002/0148847 | A1* | 10/2002 | Luburic | B65D 43/0256 220/795 |
| 2008/0179337 | A1* | 7/2008 | Vuillot | B65D 43/0258 264/513 |
| 2012/0292323 | A1* | 11/2012 | Young | B65D 43/0262 220/276 |
| 2019/0177045 | A1 | 6/2019 | Schoenmakers et al. | |

FOREIGN PATENT DOCUMENTS

| | | | |
|---|---|---|---|
| EP | 0132386 | A2 | 1/1985 |
| EP | 1717156 | A1 | 11/2006 |
| EP | 2523866 | A1 | 11/2012 |
| FR | 2921909 | A1 | 4/2009 |
| JP | S53-060451 | U | 5/1981 |
| JP | H06312769 | A | 11/1994 |
| JP | H06345202 | A | 12/1994 |
| JP | H079741 | U | 2/1995 |
| JP | 3012002 | U | 6/1995 |
| JP | H07330010 | A | 12/1995 |
| JP | 2000313459 | A | 11/2000 |
| JP | 2001139046 | A | 5/2001 |
| JP | 2004123140 | A | 4/2004 |
| JP | 2008074568 | A | 4/2008 |
| JP | 2009241970 | A | 10/2009 |
| JP | 2012091837 | A | 5/2012 |

OTHER PUBLICATIONS

The Examination Report, dated Jul. 8, 2022, in the related Indian Application No. 202117021726.

The English translation of the Brazilian Office Action, dated Feb. 23, 2023, in the related Brazilian Patent Application No. BR112021008803-2.

* cited by examiner

PACKAGING WITH TAMPER-EVIDENT SEAL

The invention relates to a packaging comprising, on the one hand, a plastic container comprising lateral walls meeting in corners, a bottom and an upper opening, as well as a lid intended to cover the upper opening of the container.

TECHNICAL FIELD

The field of the invention is that of plastic packaging obtained conventionally by injection molding of the lid and of the container. the other, elastically.

PRIOR ART

Known from the state of art is packaging wherein the container and the lid respectively have a first engagement part, at the upper opening of the container, and a second engagement part, at the periphery of the lid intended to the elastically interlocked with one another.

The first engagement portion of the lid comprises an outwardly directed ridge extended over the periphery, the second engagement portion of the lid being provided with an inwardly directed ridge, arranged on a second engagement portion skirt, which is able to latch below the outwardly directed ridge of the container, in order to ensure the locking of the lid onto the container.

The outwardly directed ridge of the container, on the one hand, and the inwardly directed ridge of the lid, on the other hand, have curved corner sections in the corners where said lateral walls meet, said curved corner sections connecting the lateral sections of the respective ridges.

In such state of art, the placement and locking of the lid onto the container is done by force, conventionally by means of a cylinder actuator that presses at the center of the lid in order to cause the interlocking of the first engagement portion of the container into the second engagement portion and until the inwardly directed ridge of the lid passes above the outwardly directed ridge of the container. The surfaces in mutual engagement between the two ridges oppose the detachment of the lid.

The removal of the lid is typically performed by the end-user and can prove difficult for some, and may even require aid of a tool such as a screwdriver to detach the lid from the container.

However, there is packaging in the state of art equipped with functional parts of the lid and/or container, enabling the removal of the lid to be facilitated.

One of the solutions is disclosed in document EP 0110859 and consists of providing a foldable skirt section on the lid, at one of the curved corner sections of the inwardly directed ridge, articulated at a folding area, such as a flexible hinge, on the upper part of the second engagement portion of the lid. This foldable skirt section is able to fold from an engagement position to an outwardly directed released position such that a central part of said at least one curved corner section of the inwardly directed ridge is spaced apart by levering from the outwardly directed ridge of the upper opening and that the engagement between the respectively inwardly directed and outwardly directed ridges is thus weakened over the central part.

In the engagement position, the foldable skirt section is separated from the remaining skirt section by means of two grooves formed in the external surface of the skirt and extending downward from a folding area to the lower edge of the skirt, said grooves reducing the wall thickness of the skirt such that the skirt can be broken along the grooves in order to fold the foldable skirt section, from the engagement position thereof, into the outwardly directed position thereof.

Such a solution comprising a foldable skirt section greatly facilitates the opening of the lid at the location where it is most difficult (i.e., a corner), by weakening the connection between the lid and the container in this corner, and advantageously combines a tamper-evident function, the two breakable grooves being irreversibly broken after the skirt section is lifted. In document EP 0110859, the inwardly directed ridge is borne by the foldable skirt section, located below the flexible hinge between the foldable skirt section and the second engagement part. However, it is possible to provide the inwardly directed ridge above the flexible hinge as disclosed in document EP223866, and in such a way that this ridge is not severed when the foldable skirt section is lifted, and in order to preserve the seal between the lid and the container after the first opening.

According to findings by the inventors, however, such a tamper-evident system is not completely reliable: it is still possible to detach the lid of the container while maintaining the foldable skirt section in the engagement position thereof, i.e. without having to lift and thus sever the two breakable grooves. For example, it is quite often possible to detach the lid at a corner by simultaneously pressing with one hand forcefully under the skirt section, exerting a force that tends to unlatch the lid, and with the other hand forcing the skirt section radially towards the container, thus avoiding the severing of the grooves. In this way the detachment of the lid is achieved without breaking the breakable grooves. It is also known from the state of art to double the latched ridges at the corners with another pair of ridges, respectively directed outwardly and inwardly, mutually engaging so as to latch together, arranged respectively on the first engagement portion of the container and on the second part, in order to augment the latching at the corner. According to findings by the inventors, providing a double pair of mutually latching ridges at the corners does not always prevent tampering because it remains possible to play with the elasticity of the plastic in order to succeed in detaching the lid, still without breaking the breakable grooves.

SUMMARY

The purpose of the present invention is to remedy aforementioned disadvantages by proposing a packaging comprising a lid and a container of the type described in document EP 0110859, which comprises a foldable skirt section facilitating the detachment of the lid, reducing, or at the very least substantially limiting the risks of tampering, namely the detachment of the lid without breaking breakable grooves serving as tamper-evidence.

Another purpose of the present invention is to propose such packaging the design of which does not complicate the injection molding equipment required for manufacturing it, and therefore its production cost.

Another purpose of the present invention is to propose such packaging for which the resistance to load during stacking of packaging is substantially improved relative to aforementioned state of art. Other purposes advantages of the invention will become apparent through the following description which is given only by way of non-limiting example.

Also, the invention relates to a packaging comprising, on the one hand, a container, plastic, comprising lateral walls meeting at corners, an upper opening and a bottom, and on the other hand, a detachable lid of plastic configured to cover the upper opening of the container, and wherein the container is provided at the upper opening thereof with a first engagement portion bearing an outwardly directed ridge, and extending over the periphery, said lid being provided over the peripheral part thereof with a second engagement portion extending folded downward provided with an inwardly directed ridge which is able to latch below the outwardly directed ridge of the container, and wherein the second engagement portion of the lid has a skirt extending over the lower part of the second engagement portion, and wherein the outwardly directed ridge of the container, on the one hand, and the inwardly directed ridge of the lid, on the other hand, having curved corner sections in the corners where said lateral walls meet, said curved corner sections connecting the lateral sections of the respective ridges, where at least one of the curved corner sections of the inwardly directed ridge is provided with a foldable skirt section, articulated in a folding area at the upper part of the second engagement portion which is able to fold from an engagement position to an outwardly directed position in such a way that a central part of said at least one corner section of the inwardly directed ridge is separated by a levering effect of the outwardly directed ridge of the upper opening, and that the engagement between the ridges is thus weakened over the central part, and wherein said foldable skirt section is separated from the remaining section of the skirt by means of two grooves formed in the outer surface of the skirt and extending downward from a folding area to a lower edge of the skirt, said grooves reducing the thickness of the wall of the skirt in such a way that the skirt can be broken along the grooves in order to fold the foldable skirt section from the engagement position thereof toward the outwardly directed position thereof.

According to the invention:

the first engagement portion of the container bearing the outwardly directed ridge extends and is elongated below the ridge, referred to as first ridge, and ends below the first ridge by a second ridge, also outwardly directed having a curved corner section, the foldable skirt section bears at least one lug, inwardly directed, which in the position of engagement of the foldable skirt section is able to latch below the second outwardly directed ridge of the first engagement portion, at least when a force is applied to the lid tending to detach it.

Significantly, the latching of the said at least one lug on the second ridge is achieved, in the engagement position of the foldable skirt section:

in a local area only along the curved corner section of the second outwardly directed ridge, and with a latching covering between the mutually engaging faces of said at least one lug and of the second ridge, when viewed in a direction radial to the curved section of the second ridge, of larger dimension than the latching covering between the mutually engaging faces of the inwardly directed ridge and of the first outwardly directed ridge, when viewed along a direction radial to the curved section of the first ridge.

According to optional features of the invention, taken alone or in combination:

the latching covering between said at least one lug and the second ridge is at least twice as large as the latching covering between the inwardly directed ridge and the first outwardly directed ridge;

the latching covering between said at least one lug and the second ridge has a value of more than 2 mm and preferably less than 4 mm;

said at least one lug extends longitudinally along the second ridge in a dimension less than ⅓, even ⅕ of the length of the second ridge over the curved corner section;

the foldable skirt section of the lid has a through recess extending along the height of the foldable skirt section, above and perpendicular to said at least one lug; in particular, said through recess extends from the lower part thereof from said at least one lug and up to the folding area between the foldable skirt section and the upper part of the second engagement portion, and only over the length of the lug;

in the engagement position of the foldable skirt section, and when no exterior force is applied to the lid, the latch between the inwardly directed ridge and the first outwardly directed ridge is free, while a clearance separates the second outwardly directed ridge and the said at least one lug positioned below the second ridge; in other words, said lug comes into latching contact with the second ridge only when the lid is subjected to a force;

the container comprises four lateral walls meeting at four corners, the inwardly directed ridge of the lid having four curved corner sections with four foldable skirt sections, each bearing said at least one lug of the foldable skirt section, capable of latching with the second outwardly directed ridge of the container;

the foldable skirt section bears said at least one lug, as well as the inwardly directed ridge, both positioned under the folding area, in the engagement position of the foldable skirt section;

the peripheral wall of the lid immediately extending the second engagement portion comprises, along the edges of the lid, on the lateral sections between the curved corner sections where the inwardly directed ridge of the lid latches the outwardly directed ridge of the container, counter-support ribs, projecting, vertical, positioned under the lid, oriented outwardly, forming between the curved corner sections a plurality of counter-supports on the inner faces of the walls of the container, distributed over the periphery of the container, reinforcing the latching between the ridges of the lateral sections along the edges of the lid between the curved corner sections;

the density of the counter-support ribs along the edge of the lid is, over the median part between two curved corner sections, greater than the density of the counter-support ribs over the outer parts in proximity to the curved corner sections, on either side of the median part;

the peripheral wall extending the second engagement portion connects the second engagement portion to the horizontal wall of the lid, while being inclined relative to the horizontal wall, for example by an angle $\alpha$ of between 45° and 70°, the peripheral wall defining with the inner walls of the container a groove G opening below the under face of the lid inside which said counter-support ribs extend in protrusion;

each counter-support rib is triangular in shape, adjoining the peripheral wall by the largest side of the triangle, while a second side of the triangle, substantially horizontal, is oriented in the extension of the horizontal wall of the lid, the third side forming a support area on the inner face of the container;

the third side has a section of greater length, forming the support area on the inner face of a lateral wall of the container, and a section of smaller length, reduced so as not to press on the lateral wall, angle formed between the second side and the third side being rounded;

the lid comprise wedging ribs, extending in projection over the periphery of the lid, towards the interior relative to the second engagement portion and upward relative to the horizontal wall of the lid, said wedging ribs being distributed over the inner periphery of the second engagement portion, in such a way as to receive among them the lower part of a container, while centering it, of an identical packaging superimposed on the horizontal wall of the lid, said wedging ribs constituting stops with the lower part of the lateral walls of the superimposed container;

the counter-support ribs are, at least in part, ribs located relative to the peripheral wall in the extension of the wedging ribs; said counter-support ribs and said wedging ribs are co-planar by pairs;

each wedging ribs extends in height from the horizontal wall of the lid and above the lower part of the second engagement portion, and inwardly, from the second engagement portion up to the horizontal wall, partially covering the horizontal wall, each wedging rib being adjacent at the level of a first ridge along the horizontal wall of the lid, at a second ridge along the inclined peripheral wall, and over a portion of the height of the second engagement portion, along a third ridge;

the second engagement portion forms a groove open downward, receiving the first engagement portion, the second engagement portion comprising an inverted U-shaped section, including a first longitudinal section extending the upper wall of the lid (including, if applicable, said peripheral wall), followed by a second longitudinal section, inclined relative to the first section, for example horizontal, followed by a third longitudinal section, inclined relative to the second section and extending downward, forming said skirt, said third section bearing the inwardly directed ridge.

The invention further relates to a method for manufacturing a packaging according to the invention, wherein said container and said lid are obtained by injection molding.

BRIEF DESCRIPTION OF THE DRAWINGS

Other features, details and advantages will appear from reading the following detailed description, and by analyzing appended drawings in which.

DESCRIPTION OF EMBODIMENTS

Figure 1:
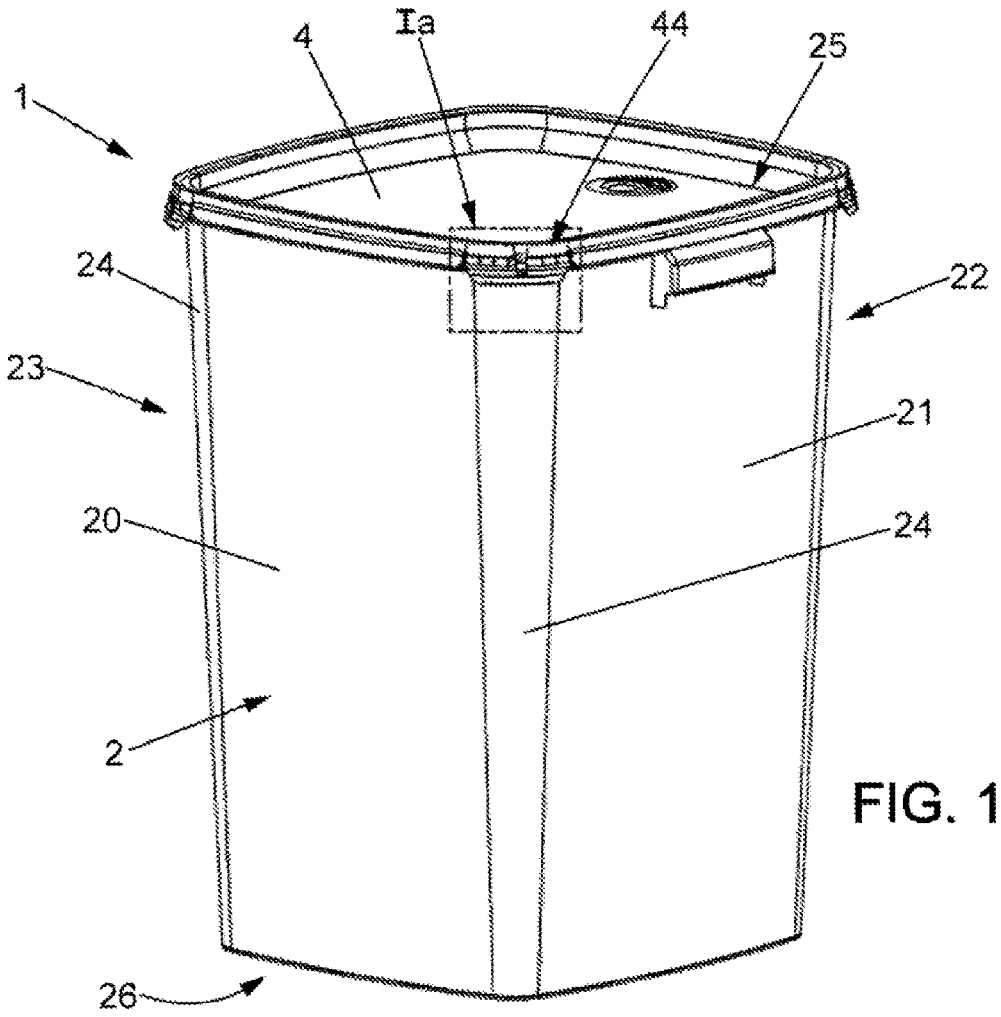
FIG. 1 is a perspective view of a packaging according to the invention comprising a container the upper opening whereof is sealed by a lid of said packaging.

The drawings in the following description essentially contain elements of a certain nature. They therefore not only will serve for better comprehension of the present disclosure, but also contribute to the definition thereof, where applicable.

The invention relates to a packaging 1 comprising, on the one hand, a plastic container 2 comprising lateral walls 20, 21, 22, 23 meeting in corners 24, an upper opening 25 and a bottom 26 and, on the other hand, a detachable plastic lid 4 configured to cover the upper opening of the container.

The lateral walls 20, 21, 22, 23 may be substantially divergent, together forming a truncated pyramid, configured so that the container can be stacked in an identical container.

The container 2 is provided, at the upper opening 25 thereof, with a first engagement portion 27 bearing an outwardly directed ridge 28 and extending over the periphery, said lid 4 being provided over the peripheral part thereof with a second engagement portion 40 extending downward in a folded manner and provided with an inwardly directed ridge 41, which is able to latch below the outwardly directed ridge 28 of the container.

Figure 4:
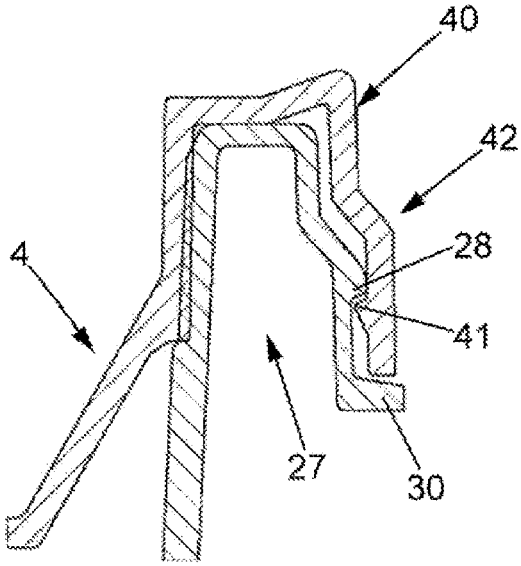
FIG. 4 is a sectional view showing the interlocking of the first part of the container onto the second part of the lid, and along a cutting plane passing through a lateral side of the lid.
Figure 5:
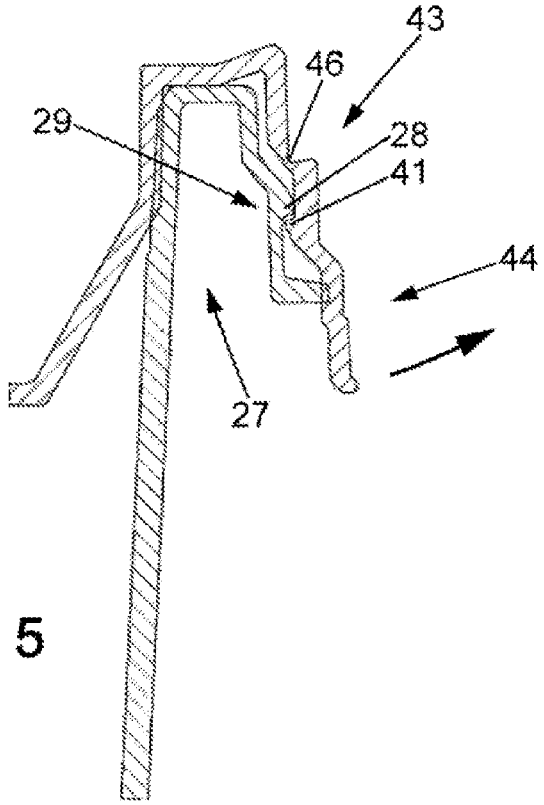
FIG. 5 is a view in cross section showing the interlocking of the first part of the container onto the second part of the lid, and along a cutting plane passing through the foldable skirt section without passing through the lug.

Also, and in the sectional view of FIG. 4, it will be noted that the first engagement portion 27 penetrates a groove of the second engagement portion 40, open downward. The first engagement portion 27 comprises an inverted U-shaped cross-section, including a first longitudinal section extending the inner wall upward, followed by a second longitudinal section, inclined relative to the first section, for example horizontal, followed by a third longitudinal section, inclined relative to the second section and extending downward, this third section bearing the outwardly directed ridge 28, and terminating in part by a second ridge 30.

Also, and in the sectional view of FIG. 4, it will be noted that the first engagement portion 40 forms a groove open downwards, receiving the first engagement portion 27. The second engagement portion 40 comprises an inverted U-shaped cross-section, including a first longitudinal section extending the upper wall, followed by a second longitudinal section, inclined relative to the first section, for example horizontal, followed by a third longitudinal section, inclined relative to the second section and extending downward forming a skirt 42, this third section bearing the inwardly directed ridge 41.

The second engagement portion of the lid thus has the skirt 42 that extends over the lower part of the second engagement portion 40, the outwardly directed ridge 28 of the container, on the one hand, and the inwardly directed ridge 41 of the lid 4, on the other hand, having curved corner sections 29, 43 in the corners where said lateral walls meet, said curved corner sections connecting the lateral sections of the respective ridges.

At least one of the curved corner sections 43 of the inwardly directed ridge 41 is provided with a foldable skirt section 44, articulated at a folding area 46 in the upper part of the second engagement portion 40 which is able to be folded from an engagement position P1 to an outwardly directed position such that a central part of said at least one curved corner section of the inwardly directed ridge 41 is spaced apart by levering from the outwardly directed ridge 28 of the upper opening, and that the engagement between the ridges 28, 41 is thus weakened over the central part.

Such a foldable skirt section facilitates the detachment of the lid by the user without the need to use a tool such as a screwdriver: the weakening is achieved simply by deviating outward the foldable skirt section 44 which pivots relative to the rest of the lid around the folding area 46.

According to the invention, said foldable skirt section 44 is, in the engagement position thereof, separated from the remaining skirt section by means of two grooves 45 formed in the external surface of the skirt and extending downwardly from a folding area to the lower edge of the skirt; said grooves 45 reducing the wall thickness of the skirt such that the skirt can be broken along the grooves in order to fold the foldable skirt section into the outwardly directed engagement position P1 thereof. These grooves 45, once irreversibly broken, constitute tamper evidence.

According to the invention and in a remarkable manner, the first engagement portion 27 of the container bearing the outwardly directed ridge 28 extends and is elongated below said ridge, referred to as first ridge, and ends below said first ridge in a second ridge 41, also outwardly directed, having a curved corner section.

Thus, it will be noted that in FIG. 4 the third longitudinal section bearing the ridge 28 is elongated below this outwardly directed ridge 28 and ends by a second outwardly directed ridge 30.

Figure 6:
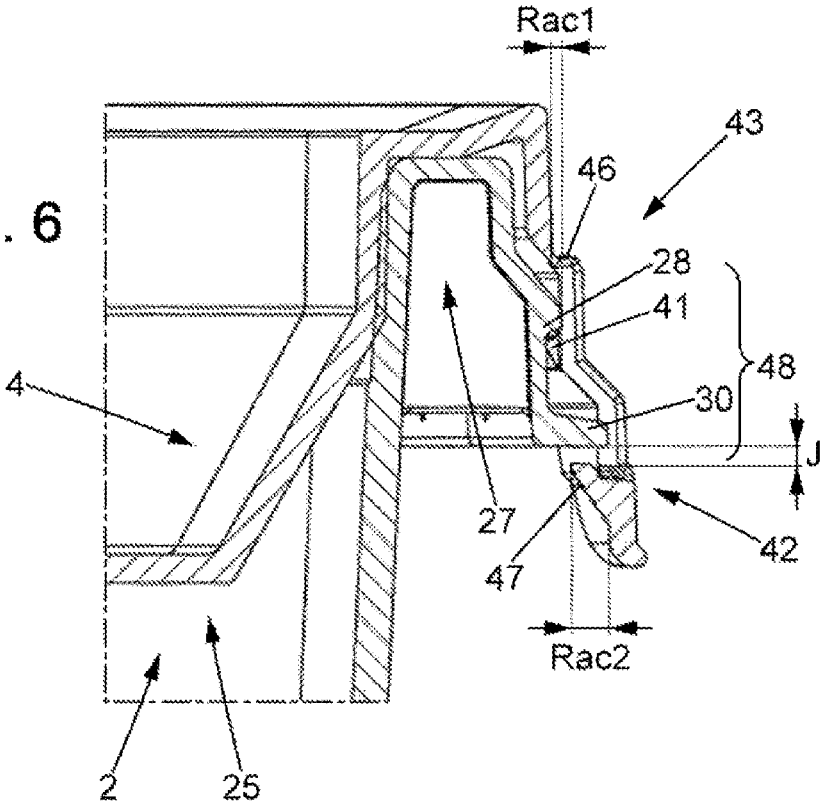
FIG. 6 is a view in cross section showing the interlocking of the first part of the container onto the second part of the lid, and along a cutting plane passing through the foldable skirt section, passing through the lug.
Figure 7:
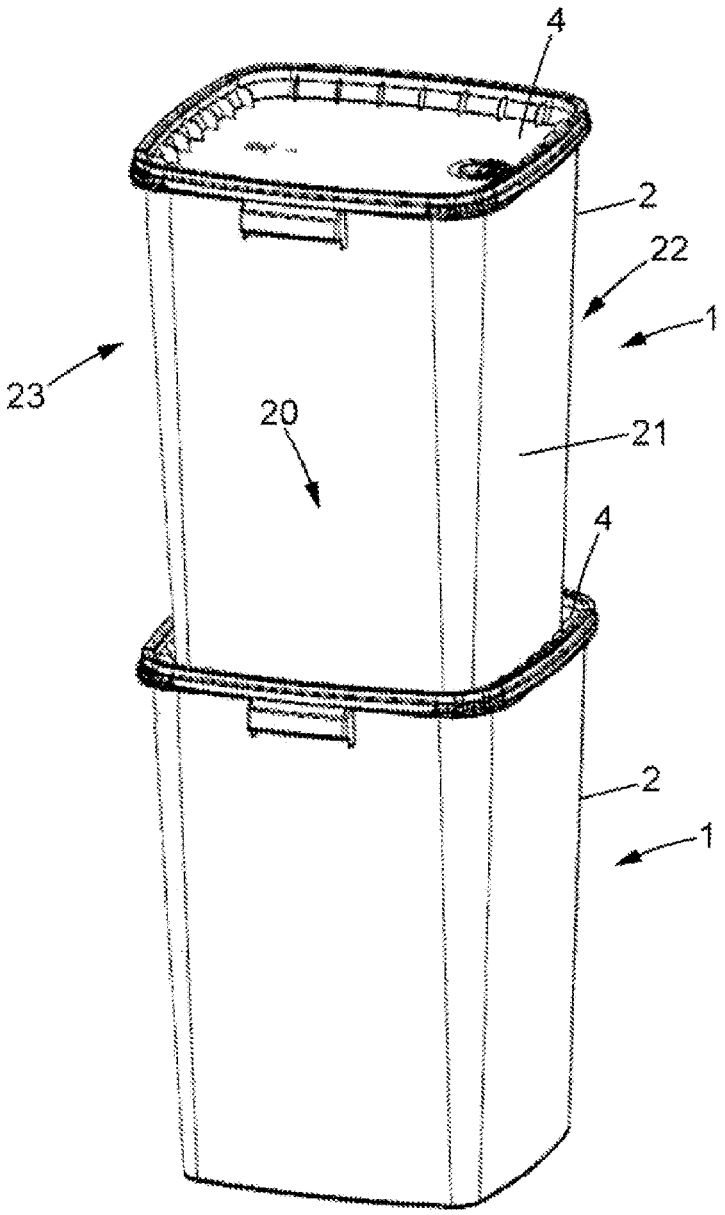
FIG. 7 is a perspective view of two packagings according to the invention stacked one upon another, according to a second embodiment, having not only lugs reinforcing the latching of the lid on the corners, but also counter-support ribs, outwardly protruding, resting on the inner faces of the lateral walls of the container advantageously reinforcing the latching between the rib of the inwardly directed lid and the rib of the container, directed outwardly, along edges between the corners.

It will be noted in FIG. 6 that the foldable skirt section 42 bears at least one inwardly directed lug 47, which in the engagement position P1 of the foldable skirt section is able to latch under the second outwardly directed ridge 30 of the first engagement portion, at least when force is applied to the lid tending to detach it.

In a remarkable way, the latching of said at least one lug 47 on the second ridge 30 is achieved, in the engagement position P1 of the foldable skirt section in only one local area, along the curved section of the second outwardly directed ridge 30; the lug 47 extends along the length of the second ridge 30 only over a part of the second ridge 30; for example the lug extends along the second ridge along a dimension less than ⅓, even ⅕ of the length of the second ridge 30 over the curved corner section.

Notably, the latching covering Rac2 between the mutually engaging faces of said at least one lug 47 and the second ridge 30, along a direction radial to the curved section of the second ridge 30, is larger in size than the latching covering Rac1 between the mutually engaging faces of the inwardly directed ridge 41 and of the first outwardly directed ridge 28, along a direction radial to the curved section of the first ridge 28.

The latching coverings Rac2 and Rac1 can be seen for illustrative purposes in FIG. 6; it will be noted that the latching covering Rac2 between the lug 47 and the second ridge 30 is significantly larger than the latching covering Rac1 between the inwardly directed ridge 41 and the outwardly directed ridge 28.

Also, and in the event of attempt at tampering, and even assuming that the inwardly directed ridge 41 is released from the first ridge 28 due to the weaker latching covering Rac1, said at least one lug 47 will always latch the second ridge 30 due to a larger latching covering Rac2; by way of example, the latching covering Rac2 between said at least one lug 47 and the second ridge 30 is at least twice as large as the latching covering Rac1 between the inwardly directed ridge 41 and the first outwardly directed ridge 28.

Thus, it only becomes possible to release said at least one lug 47 from the second ridge 30 by folding the foldable skirt section 44 and advantageously by an amount of displacement requiring the breakage of the grooves 45. Thus, the reliability of this tamper-evident system is substantially increased.

In this regard, it will be noted that the size of the inwardly directed lug 47 is significantly greater than the size of the inwardly directed ridge 41. In this regard, the foldable skirt section 42 of the lid 4 may have a through recess 48 extending along the height of the foldable skirt section 44, above and perpendicular to said at least one lug 47. The function of this recess is to facilitate the demolding of the lid after injection molding during the manufacture thereof; otherwise, the large size of the lug towards the interior, necessary for obtaining the latching covering Rac2, makes the demolding cumbersome, even impossible without special arrangement of the mold.

It will be noted that this through recess 48 inherently makes the foldable skirt section 44 fragile; also, this recess extends only over area necessary to facilitate the demolding, that is to say, that this recess is located perpendicular to said at least one lug 47, which itself extends over a small longitudinal section along the corner section 43, and in order to limit the size of this recess. In the end, a compromise is obtained between the facility of implementation during the injection molding manufacturing method, and the strength of the latching between the foldable skirt section and the container in that corner.

Figure 1A:
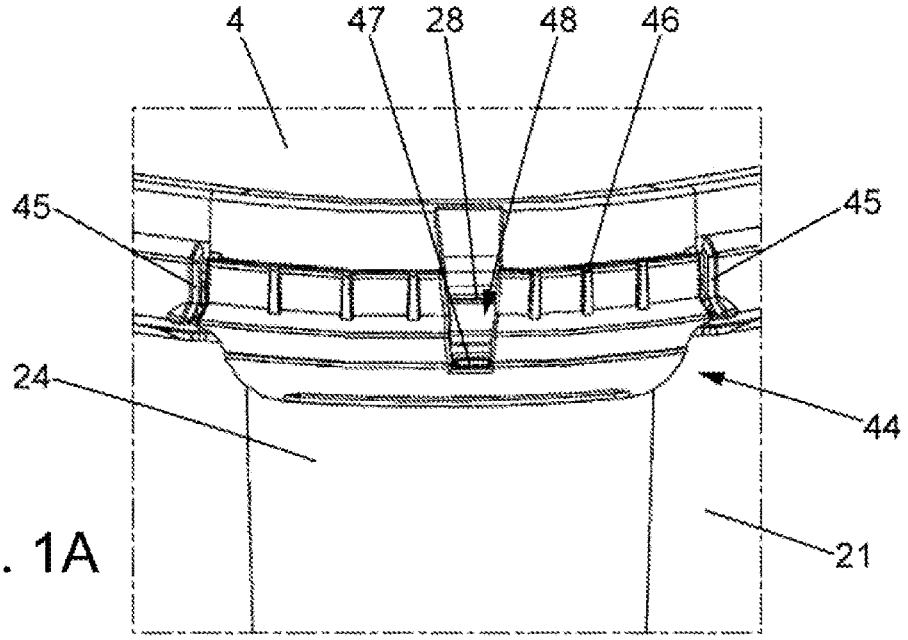
FIG. 1A is a detailed view of FIG. 1, showing the foldable skirt section, at a corner, in its engagement position, separated from the remaining portion of the skirt by two grooves, breakable, with the presence of a recess passing through the skirt section, perpendicular to a lug, the recess extending from the lug up to the height of the folding area authorizing the raising of the skirt section from its engagement position to its outwardly directed position.
Figure 2:
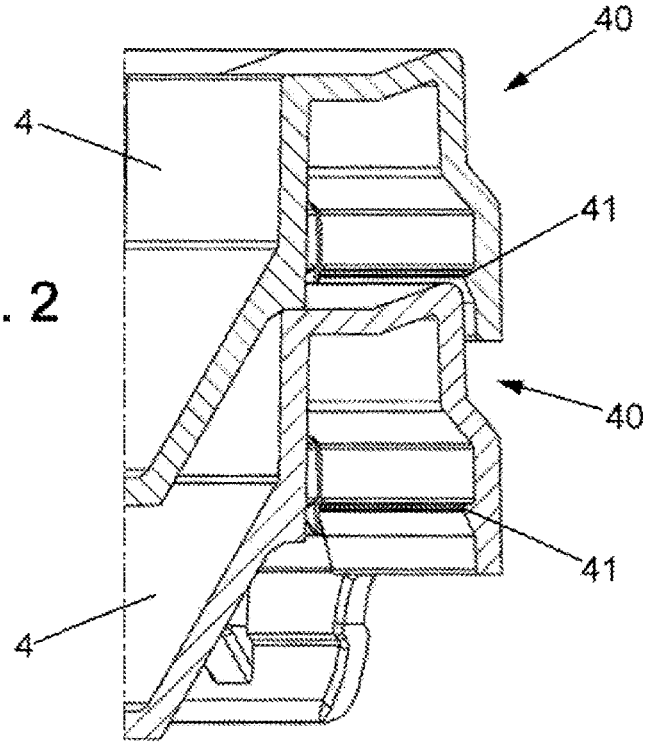
FIG. 2 is a view of two lids stacked one upon the other, and along a cutting plane passing through the lateral sides of the lids.
Figure 3:
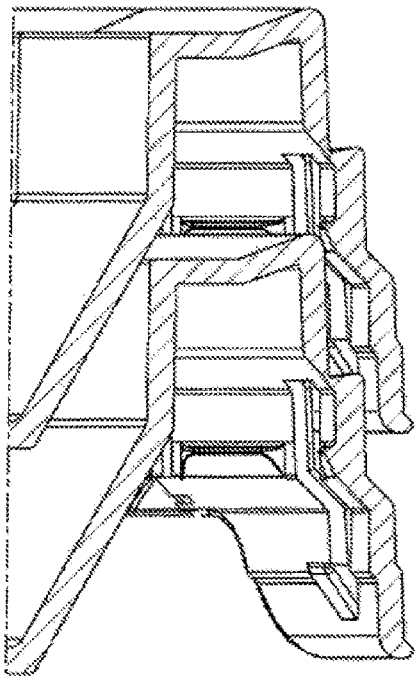
FIG. 3 is a view of two lids stacked one upon the other and along a cutting plane passing through a direction radial to the corner section of two of the corners of the lid.

As shown in FIG. 1*a*, said through recess 48, extends for example starting from the lower part thereof from said at least one lug 47 and up to the folding area 46 between the foldable skirt section 44 and the upper part of the second engagement portion 40, and only over the length of the lug 47.

In the engagement position P1 of the foldable skirt section, and when no external force is applied to the lid as shown in FIG. 6, the latching between the inwardly directed ridge 41 and the first outwardly directed ridge 28 is open, while a clearance J may separate the second outwardly directed ridge 30 and said at least one lug 47 positioned under the second ridge 30; in such a case, said lug 47 comes into latching contact with the second ridge 30 only when the lid 4 is subjected to a force, for example a force tending to detach the lid, or when there is a significant load on the lid, such as for example when the packagings according to the invention are stacked one upon the other.

In that regard, the invention also makes it possible to improve the packaging's resistance to stacking, and more particularly the performance of the lid of the lowest packaging in the stack; under the effect of the weight of the column, in the packaging of the state of art the lid may become unlatched and literally collapse through the opening of the container. The invention, due to the latching of said at least one lug, allows better resistance to collapse. In such a case, at least one lug 47 and at least one foldable skirt section may be provided on each corner of the packaging.

According to the shown embodiment, the foldable skirt section 44 bears said at least one lug 47, as well as the inwardly directed ridge 41, both positioned beneath the folding area 46, in the engagement position P1 of the foldable skirt section 44; the inwardly directed ridge 41 is therefore severed when the foldable skirt section 44 is raised from the engagement position P1 thereof. Alternatively, and as taught by document EP 2523866, the inwardly directed ridge 41 may be located above the folding range 46 so that the raising of the foldable skirt section does not sever the inwardly directed ridge 41, preserving the sealing properties of the lid with the first opening.

According to an shown embodiment, the container comprises four lateral walls meeting at four corners, the inwardly directed ridge 41 of the lid having four curved corner sections 43 with four foldable skirt sections 44, each bearing at least one lug 47 of the foldable skirt section, capable of latching with the second outwardly directed lug 30 of the container. At least four lugs 47 provide a reliable latching of the lid at the four corners of the container, which further increases the latching connection between the lid and the container.

Advantages and Disadvantages of the First Embodiment

First of all, the presence of lugs 47 particularly at the four curved corner sections 43 considerably improves the reliability of the tamper-evident system, requiring the user to break the grooves 45 to disengage the lugs 27 of the second ridge 30

The invention also makes it possible to improve resistance to stacking of the packaging, and more particularly the performance of the lid of the lowest packaging in the stack, under the effect of the weight of the column. On the contrary, and in the packaging of the state-of-the-art the lid may become detached and literally collapse through the opening of the container. By the latching of said at least lug at the corners, the invention enables better resistance to collapse, the lid remaining latched to the container at least at the four corners having said lugs.

According to the embodiment shown in FIGS. 1 to 6, during stacking, and more particularly in the event of a heavy load, the container deforms the lid and creates strong internal tensions that propagate to the second engagement portion 40. During heavy load, and according to the observations of the inventors, it may be found that the lid remains latched by the corners thereof, due to action of the lugs 27 that abut against the second ridge 30, under the effect of the deformations during the load, while eliminating the clearance J, advantageously avoiding the collapse of the lid into the container. However, in the event of a heavy load, the internal tensions may be of such intensity that the ridges 28, 41 between the lid and the container become detached along the edges of the lid between the corners on the lateral sections of the ridges 28, 41, and in particular at the median parts over the periphery of the lid, away from the corners. This then results in a significant loss of seal between the lid and the container. The improvement described below makes it possible to deal with this problem.

Improvement Obtained by the Second Embodiment

The second embodiment shown in FIGS. 7 to 11 is advantageous in that it achieves a reinforcement of the latching between the first engagement portion of the container and the second engagement portion of the lid, not only at the corners but also along the edges between the corners on the lateral sections of the ridges 28, 41.

Significantly, (and as with the first embodiment, this second embodiment comprises first of all, said at least one lug 47 configured to latch, the second ridge 30 of the container, and according to the latching covering previously described, large, which ensures, not only that the grooves 45 be severed to release said at least lug 47 from the second ridge 30, but also to maintain the lid on the container during stacking, by resisting deformation and stresses under the load, owing to a robust latching at the corners of the lid having said at least lug, along the curved corner sections 43.

Figure 8:
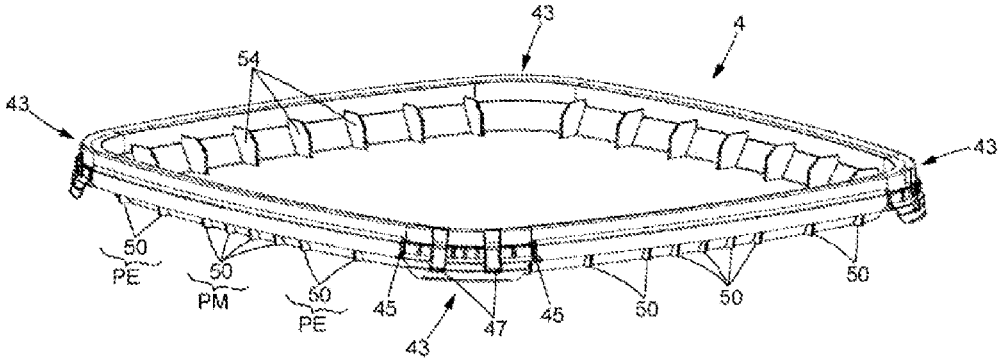
FIG. 8 is a perspective view of the lid of the packaging of FIG. 7, this lid being remarkable in that it comprises counter-support ribs, under the lid, distributed over the periphery of the lid along edges between the corners of the lid, intended to promote the latching of the lid onto this area, and wedging ribs, protruding over the upper part of the lid, intended to promote the wedging and centering of an identical packaging stacked on the lid.

First of all, it will be noted in FIG. 8 that the latching can optionally be reinforced, again at the corners, with the presence of two lugs 47 on each foldable skirt section 44; at the curved corner sections. Doubling the lugs 47 per corners can be a general measure according to the invention, and not limited to this particular embodiment.

Also significantly (and specific to this second embodiment), it will also be noted that the peripheral wall 49 of the lid immediately extending the second engagement portion 40 comprises along edges of the lid on the lateral sections between the curved corner sections 43 where the inwardly directed ridge 41 of the lid latches the outwardly directed ridge 28 of the container, counter-support ribs 50, projecting, vertical, positioned beneath the lid, oriented outwards.

These counter-support ribs 50 are significant for dealing with the problem identified above for the first embodiment in that they advantageously form a plurality of counter-supports Ap on the inner faces of the lateral walls 20, 21, 22, 23 of the container, distributed over the periphery of the container on the lateral sections of the ridges 28, 41 between the curved corner sections 43. These counter-support Ap advantageously reinforce the latching between the ridges 28, 41 along edges of the lid on the lateral sections of the ridges 28, 41 between the curved corner sections 43.

Figure 10:
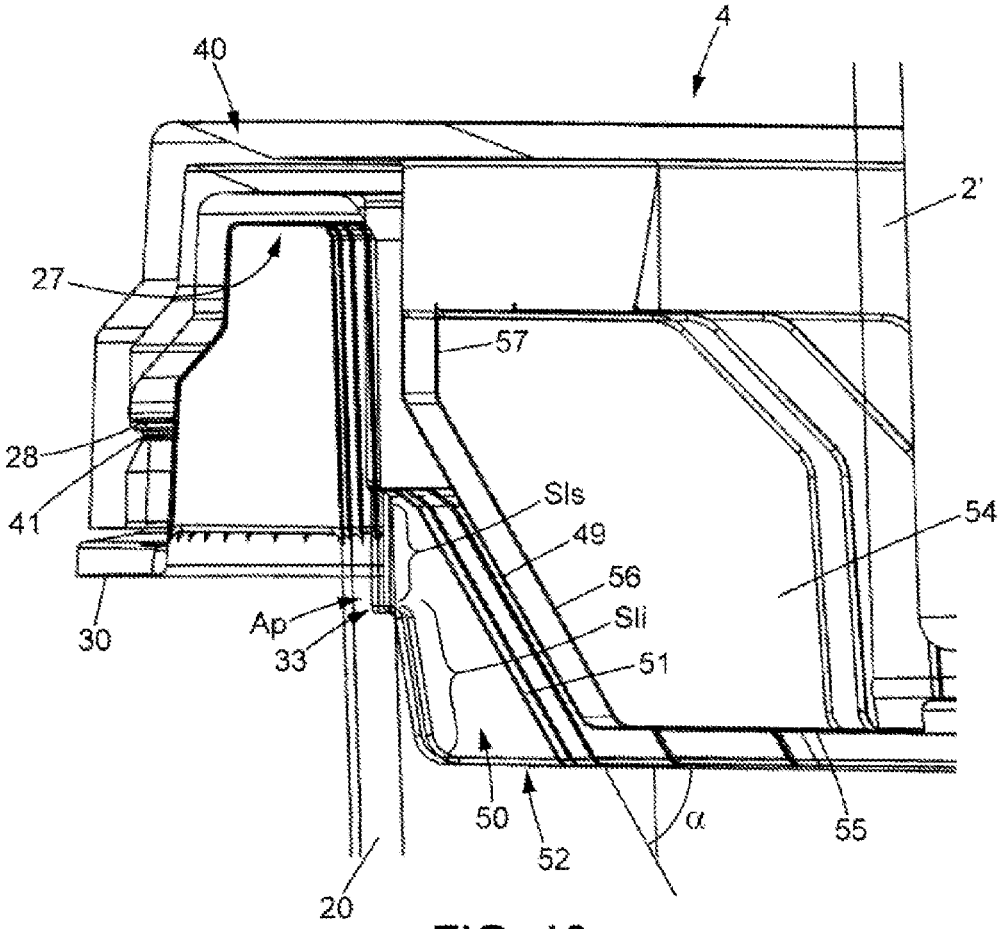
FIG. 10 is a sectional view along a vertical plane passing through the median part between two corners of the packaging, showing the latching between the inwardly directed rib (of the lid) and the outwardly directed rib (of the lid), and its reinforcement owing to the counter-support rib coming into contact against the inner face of the lateral wall of the lid, this counter-support rib protruding from a peripheral wall inclined relative to the horizontal wall of the lid, the counter-support rib being triangular in shape, adjoining by its largest side, having a second side extending from the horizontal wall, and a third side forming a support ridge, angle formed between the second side and the third side being rounded.
Figure 11:
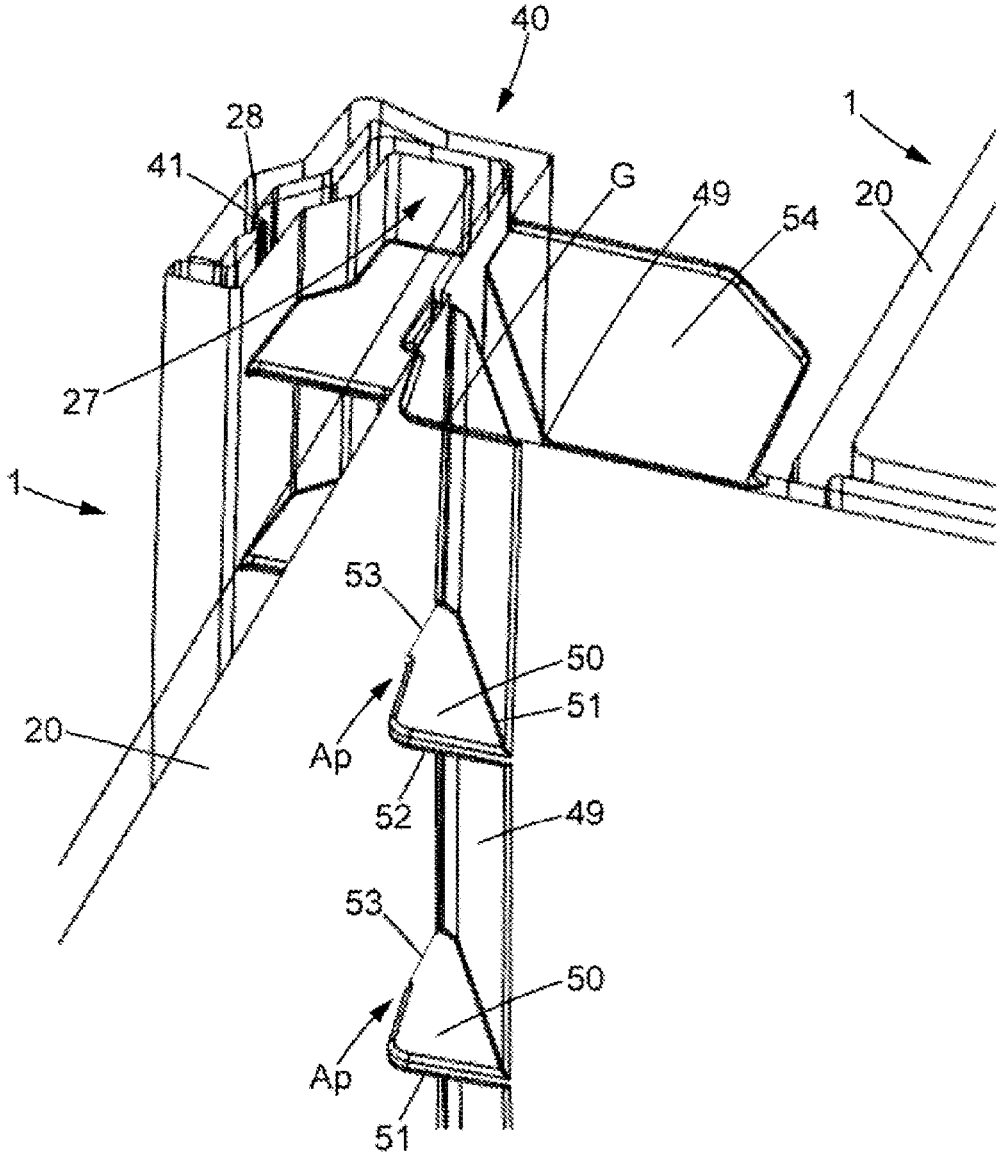
FIG. 11 is a sectional view, viewed from below, showing action of the counter-support ribs to reinforce the latching of the mutually latched ribs between the lid and the container, and action of the wedging ribs for centering the container stacked on the lid.

During stacking of a packaging on the lid of an identical packaging, advantageously, thanks to the combined presence of the lugs 47, on the foldable skirt sections 44, at the corners, on the one hand, and counter-support ribs 50, along the edges between the corners, on the other hand, a good holding of the latching is obtained of the lid on the container without disengaging the ribs 28, 41 over the full periphery of the lid, i.e., not only at the corners but also along the edges between the corners As can be seen in FIGS. 10 and 11, the second engagement portion 40 forms a groove G open downward, receiving the first engagement portion 27. The second engagement portion 40 comprises an inverted U-shaped cross-section, including a first longitudinal section extending the upper wall of the lid (including immediately the peripheral wall 49 extended by a central horizontal wall of the lid), followed by a second longitudinal section, inclined relative to the first section, for example horizontal, followed by a third longitudinal section, inclined relative to the second section and extending downward forming a skirt 42, this third section bearing the inwardly directed ridge 41.

The peripheral wall 49 extends the second engagement portion 40 by connecting the second engagement portion to the horizontal wall of the lid. As can be seen in FIGS. 10 and 11, this peripheral wall 49 can be inclined relative to the horizontal wall, the central one of the lid, for example by an angle $\alpha$ of between 30° and 70°, particularly between 45° and 70°. This wall 49 descends from the second engagement portion 40 toward the horizontal wall. This peripheral wall 49 defines with the lateral walls 20; 21; 22; 23, when the lid is attached to the container (by latching of ribs 28, 41) a groove G, opening below the under face of the lid 4 and which runs over the inner periphery of the container. It will also be noted that the counter-support ribs 50 extend into this groove G, in counter-support Ap on the inner face of the lateral wall 20; 21; 22; 23. These supports prevent the convergence of the peripheral wall 49 under load during stacking. Thus, advantageously such deformation is avoided, which tends to open the U-shaped section of the second engagement portion 40, promoting the detachment of the ridges 28, 41 along the edges. A better maintenance of the latching is advantageously achieved between the ridges 28 and 41 along the edges of the packaging between the corners.

The density of the counter-support ribs 50 along the edge of the lid 4, on the median part PM of the lateral section between two curved corner sections 43, may be greater than the linear density of the counter-support ribs 50 on the end parts PE of the lateral section in proximity to the curved corner sections 43, on either side of the median part PM In FIG. 8, it will be noted that the median part PM comprises five counter-support ribs 50 along the length of the edge between two corners, while the two end parts PE have a lower linear density, with only two counter-support ribs.

As can be seen in FIGS. 10 and 11, each counter-support rib 50 may be triangular in shape, adjoining the peripheral wall 49 by the largest side 51 of the triangle called first side, while a second side 52 of the triangle, substantially horizontal, is oriented in the extension of the horizontal wall of the lid and particularly at the under face thereof, the third side 53 forming a support area on the inner face of the container. It will also be noted that the third side 52 has a longer section Sls, forming the counter-support Ap on the inner face of the lateral wall of the container, and a shorter section Sli, reduced so as not to press on the lateral wall, angle formed between the second side 52 and the third side 53 being advantageously rounded. Thus, the presence is avoided of a sharp angle likely to impair the contents, or even puncture a flexible pouch used to package the materials inside the container.

As can be seen in FIG. 8, the lid 4 can also comprise wedging ribs 54 extending in protrusion over the periphery of the lid, inwardly relative to the second engagement portion 40 and upward relative to the horizontal wall of the lid. The wedging ribs 54 are distributed over the inner periphery of the second engagement portion 40 so as to receive between them, while centering it, the lower part of a container of an identical packaging stacked on the horizontal wall of the lid. Said wedging ribs constitutes abutments with the lower part of the lateral walls of the stacked container, ensuring the centering thereof on the lid.

Figure 9:
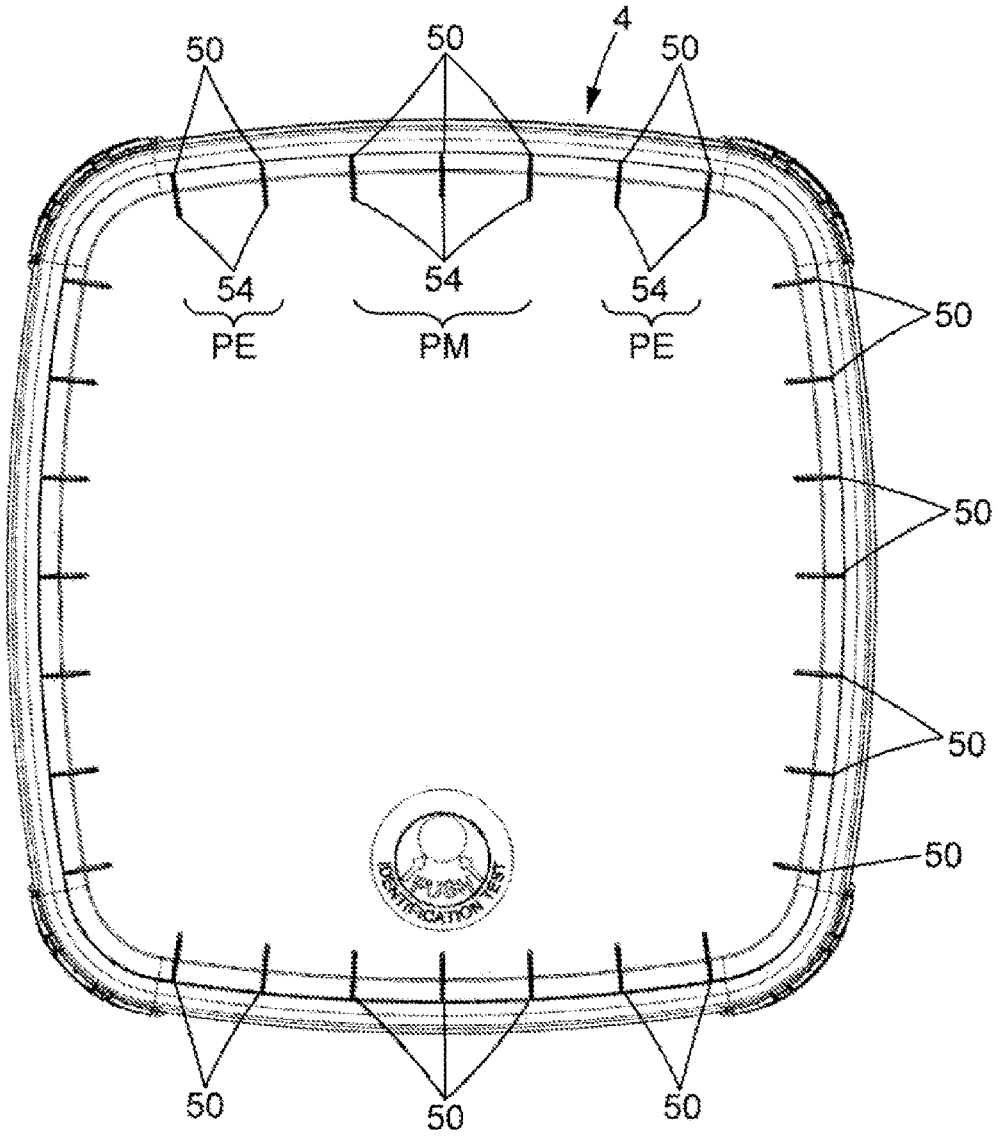
FIG. 9 is a sectional view of the lid as shown in FIG. 7 along a plane parallel to the horizontal wall of the lid, showing more particularly the relative positioning of the wedging ribs relative to the counter-support ribs, some of the wedging ribs being in the extension of the counter-support ribs.

As can be seen in FIG. 9, the counter-support ribs 50 are, at least in part, ribs situated, relative to the peripheral wall 49, in the extension of the wedging ribs 54; said counter-support ribs 50 and said wedging ribs 54 being coplanar by pairs.

Thus, it can be seen in FIG. 9, for each edge between corners of the lid:

- the median parts PM comprise three wedging ribs 54 extending respectively three counter-support ribs 50, while two other counter-support ribs 50, respectively positioned intermediately between aforementioned ribs, project from the peripheral wall 49, alone, i.e., without extending the wedging ribs;
- at the two end parts PE, on either side of the median part PM, two counter-support ribs 50 extend respectively two wedge ribs 54.

Each web ribs 54 extends upward from the horizontal wall of the lid to above the lower part of the second engagement portion 40, and inwardly, from the second engagement portion 40 to the horizontal wall, while partially covering the horizontal wall of the lid. As can be seen in FIG. 10 each wedging rib 54 is adjacent to the rest of the lid at a first ridge 55 along the horizontal wall, at a second ridge 56 along the inclined peripheral wall 49, and over part of the height of the second engagement portion along a third ridge 57. In combination with the counter-support ribs 50, these wedging ribs 54 can participate in limiting the transmission of forces under load to the second engagement portion.

Naturally, other embodiments of the invention may be considered without going beyond the scope of the invention as defined by the following claims.

LIST OF REFERENCE SIGNS

1. Packaging,
2. Container,
20, 20, 21, 23. Lateral walls,
24. Corners,
25. Upper opening,
26. Bottom,
27. Engagement portion,
28. First outwardly-directed ridge,
29. Curved corner section (ridge 28),
4. Lid,
40. Second engagement portion,
41. Second inwardly-directed ridge,
42. Skirt,
43. Curved corner section (ridge 41),
44. Foldable skirt section,

45. Breakable grooves,
46. Folding area (for example flexible hinge),
47. Lug
48. Through recess
49 Peripheral wall in extension of the second engagement portion 40
50 Counter-support ribs,
51. Large side of the triangle forming the counter-support rib,
52. Second side of the triangle in extension of the horizontal wall of the lid,
53. Third side of the triangle forming the counter-support rib,
54. Wedging ribs
55 First ridge (Rib 54)
56 Second ridge (Rib 54
57 Third ridge (Rib 54)
G. Groove
PE. End parts (lateral sections of the ribs 28, 41)
PM. Median parts (lateral sections of the ribs 28, 41)
Rac1. Rac2 Latching coverings
J. Clearance separating said lug and the second ridge when no force is applied on the lid.

The invention claimed is:

1. A packaging comprising a container, of plastic, comprising lateral walls meeting at corners, an upper opening and a bottom, and a detachable lid of plastic configured to cover the upper opening of the container, and wherein the container is provided at the upper opening thereof with a first engagement portion bearing an outwardly directed ridge, and extending over the periphery, said lid being provided over a peripheral part thereof with a second engagement portion extending folded downward provided with an inwardly directed ridge which is able to latch below the outwardly directed ridge of the container, and wherein the second engagement portion of the lid has a skirt extending over a lower part of the second engagement portion, and wherein the outwardly directed ridge of the container and the inwardly directed ridge of the lid having curved corner sections in the corners where said lateral walls meet, said curved corner sections connecting lateral sections of the outwardly directed ridge and the inwardly directed ridge, where at least one of the curved corner sections of the inwardly directed ridge is provided with a foldable skirt section, articulated in a folding area at an upper part of the second engagement portion which is able to be folded from an engagement position to an outwardly directed position in such a way that a central part of said at least one corner section of the inwardly directed ridge is separated by a levering effect of the outwardly directed ridge of at the upper opening of the container, and that the engagement between the outwardly directed ridge and the inwardly directed ridges is thus weakened over the central part, and wherein said foldable skirt section is separated from a remaining section of the skirt not being part of the foldable section by means of two grooves formed in the outer surface of the skirt and extending downward from a folding area to a lower edge of the skirt, said grooves reducing the thickness of a wall of the skirt in such a way that the skirt can be broken along the grooves in order to fold the foldable skirt section from the engagement position thereof toward the outwardly directed position thereof wherein the first engagement portion of the container bearing the outwardly directed ridge extends and is elongated below the outwardly directed ridge, referred to as first ridge, and ends below the first ridge by a second outwardly directed ridge, having a curved corner section, and wherein the foldable skirt section bears at least one lug, inwardly directed, which in the engagement position of the foldable skirt section is able to latch below the second outwardly directed ridge of the first engagement portion, at least when a force is applied to the lid tending to detach the lid, and wherein latching of the said at least one lug on the second outwardly directed ridge is achieved, in the engagement position of the foldable skirt section in a local area only along the curved corner section of the second outwardly directed ridge, and with a latching covering between mutually engaging faces of said at least one lug and of the second outwardly directed ridge, when viewed in a direction radial to the curved corner section of the second outwardly directed ridge, of larger dimension than the latching covering between the mutually engaging faces of the inwardly directed ridge and of the first ridge, when viewed along a direction radial to the curved corner section of the first ridge.

2. The packaging according to claim 1, wherein said latching covering between said at least one lug and the second outwardly directed ridge is at least twice as large as the latching covering between the inwardly directed ridge and the first ridge.

3. The packaging according to claim 1, wherein said latching covering between said at least one lug and the second outwardly directed ridge is more than 2 mm and less than 4 mm.

4. The packaging according to claim 1, wherein said at least one lug extends along the second outwardly directed ridge in a length less than ⅓, even less than ⅕ of a length of the second outwardly directed ridge over the curved corner section of the second outwardly directed ridge.

5. The packaging according to claim 1, wherein the foldable skirt section of the lid having a through recess extending along a height of the foldable skirt section, above and perpendicular to said at least one lug.

6. The packaging according to claim 5, wherein said through recess extends from a lower part thereof from said at least one lug and up to the folding area between the foldable skirt section and the upper part of the second engagement portion, and only over the length of the lug.

7. The packaging according to claim 1, wherein in the engagement position of the foldable skirt section, and when no exterior force is applied to the lid, a latch between the inwardly directed ridge and the first outwardly directed ridge is free, while a clearance separates the second outwardly directed ridge and the said at least one lug positioned below the second outwardly directed ridge, said lug coming into latching contact with the second outwardly directed ridge only when the lid is subjected to a force.

8. The packaging according to claim 1, the container whereof comprises four lateral walls meeting at four corners, the inwardly directed ridge of the lid having four curved corner sections with four foldable skirt sections, each bearing said at least one lug of the foldable skirt section, capable of latching with the second outwardly directed ridge of the container.

9. The packaging according to claim 1, wherein the foldable skirt section bears said at least one lug, as well as the inwardly directed ridge, both positioned under the folding area, in the engagement position of the foldable skirt section.

10. The packaging according to claim 1, wherein a peripheral wall of the lid immediately prolonging the second engagement portion comprises, along edges of the lid, on lateral sections between the curved corner sections where the inwardly directed ridge of the lid latches the outwardly directed ridge of the container, counter-support ribs, projecting, vertical, positioned under the lid, oriented outwardly, forming between the curved corner sections a plurality of counter-supports on inner faces of the lateral walls of the container, distributed over the periphery of the container, reinforcing the latching between the inwardly directed ridge and the outwardly directed ridges latched along the edges of the lid between the curved corner sections.

11. The packaging according to claim 10, wherein the density of the counter-support ribs located along the edges of the lid is, over a median part between two curved corner sections, greater than the density of the counter-support ribs located on end parts in proximity to the curved corner sections, on either side of the median part.

12. The packaging according to claim 10, wherein the peripheral wall prolonging the second engagement portion connects the second engagement portion to a horizontal wall of the lid, while being inclined relative to the horizontal wall, the peripheral wall defining with the inner walls of the container a groove G opening below an under face of the lid inside which said counter-support ribs extend in protrusion.

13. The packaging according to claim 12, wherein each counter-support rib is triangular in shape, adjoining the peripheral wall by a largest side of the triangle, while a second side of the triangle is oriented in an extension of the horizontal wall of the lid, a third side of the triangle forming a support area on an inner face of the container.

14. The packaging according to claim 13, wherein the third side of the triangle has a longer section, forming the support area on an inner face of a lateral wall of the container, and a shorter section, reduced so as not to press on the lateral wall, angle formed between the second side and the third side being rounded.

15. The packaging according to claim 1, comprising wedging ribs extending in projection over the periphery of the lid, toward the interior relative to the second engagement portion and upward relative to a horizontal wall of the lid, said wedging ribs being distributed over an inner periphery of the second engagement portion, in such a way as to receive among them a lower part of a container, while centering it, of an identical packaging stacked on the horizontal wall of the lid, said wedging ribs constituting abutments with a lower part of lateral walls of the stacked container.

16. The packaging according to claim 10, wherein said package further comprises wedging ribs extending in projection over the periphery of the lid, toward an interior relative to the second engagement portion and upward relative to a horizontal wall of the lid, said wedging ribs being distributed over an inner periphery of the second engagement portion, in such a way as to receive among them a lower part of a container, while centering it, of an identical packaging stacked on the horizontal wall of the lid, said wedging ribs constituting abutments with a lower part of lateral walls of the stacked container, wherein the counter-support ribs are, at least in part, ribs situated, relative to the peripheral wall of the lid, in an extension of the wedging ribs; said counter-support ribs and said wedging ribs are coplanar by pairs.

17. The packaging according to claim 12, wherein said package further comprises wedging ribs extending in projection over the periphery of the lid, toward the interior relative to the second engagement portion and upward relative to the horizontal wall of the lid, said wedging ribs being distributed over the inner periphery of the second engagement portion, in such a way as to receive among them a lower part of a container, while centering it, of an identical packaging stacked on the horizontal wall of the lid, said wedging ribs constituting abutments with a lower part of the lateral walls of the stacked container, wherein each wedging rib extends upward from the horizontal wall of the lid and above a lower part of the second engagement portion, and inwardly, from the second engagement portion up to the horizontal wall, partially covering the horizontal wall, and wherein each wedging rib is adjacent to the rest of the lid at a level of a first ridge along the horizontal wall of the lid, at a second ridge along the peripheral wall, and over a portion of a height of the second engagement portion, along a third ridge.

18. The packaging according to claim 1, wherein the second engagement portion forms a groove open downward, receiving the first engagement portion, the second engagement portion comprising an inverted U-shaped section, including a first longitudinal section extending an upper wall of the lid, a peripheral wall of the lid, followed by a second longitudinal section, inclined relative to the first section, followed by a third longitudinal section, inclined relative to the second section and extending downward, forming said skirt, said third section bearing the inwardly directed ridge.

19. A method for manufacturing a packaging according to claim 1, wherein said lid and said container are obtained by injection molding.

* * * * *